United States Patent [19]

Robbins

[11] Patent Number: 4,733,620

[45] Date of Patent: Mar. 29, 1988

[54] HEAT CHAMBER LINING

[75] Inventor: Michael K. Robbins, Parma Heights, Ohio

[73] Assignee: Schaefer Brothers Incorporated, Cleveland, Ohio

[21] Appl. No.: 59,415

[22] Filed: Jun. 8, 1987

[30] Foreign Application Priority Data

Aug. 1, 1986 [GB] United Kingdom ..... 8618852

[51] Int. Cl.[4] ..... F23M 5/00

[52] U.S. Cl. ..... 110/336; 52/506; 52/509

[58] Field of Search ..... 110/336; 52/506, 509, 52/508; 29/432

[56] References Cited

U.S. PATENT DOCUMENTS

| | | | |
|---|---|---|---|
| 3,832,815 | 9/1974 | Balaz et al. | 110/336 X |
| 4,411,621 | 10/1983 | Miller | 110/336 X |
| 4,449,345 | 5/1984 | Hounsel et al. | 110/336 X |
| 4,473,015 | 9/1984 | Hounsel . | |
| 4,494,295 | 1/1985 | Herring | 52/506 X |
| 4,524,702 | 6/1985 | Miller et al. . | |
| 4,549,382 | 10/1985 | Byrd, Jr. | 110/336 X |

FOREIGN PATENT DOCUMENTS

| | | |
|---|---|---|
| 165205 | 4/1985 | European Pat. Off. . |
| 1152718 | 8/1963 | Fed. Rep. of Germany . |
| 2376929 | 8/1978 | France . |

*Primary Examiner*—Edward G. Favors

*Attorney, Agent, or Firm*—Nixon & Vanderhye

[57] ABSTRACT

An insulating lining is made up of modules of ceramic fibre, each hung over a module rod. The modules are held in tight side by side relation by engaging the rods with respective engaging means spaced along a hanger rod extending through the modules. The engaging means are spaced apart by a distance selected according to the degree of compression desired in the modules.

19 Claims, 3 Drawing Figures

HEAT CHAMBER LINING

Figure 1:
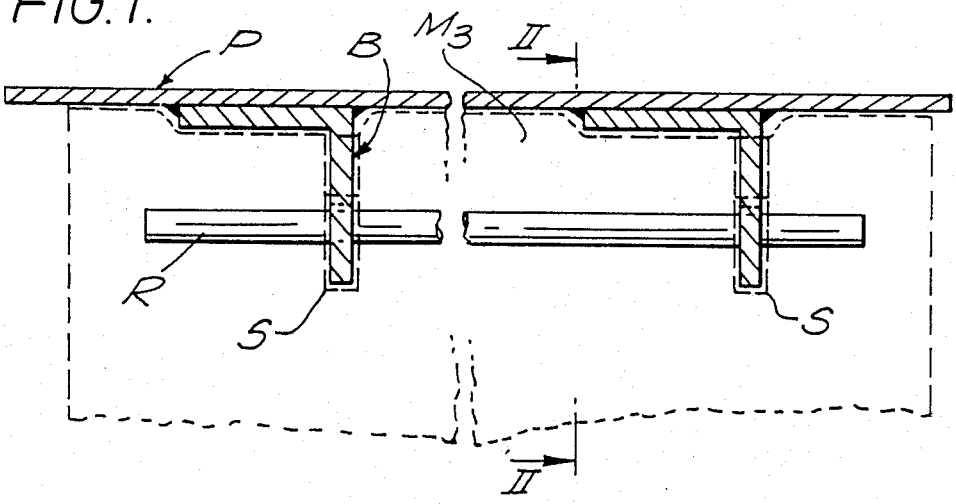

The invention relates to the heat insulation of the wall of a heat chamber, and in particular to a method of assembly or repair of a layer of heat insulating lining of such a wall.

It is known to locate a layer of heat insulating material e.g. ceramic fibre material along the inner surface of the heat chamber wall. It is known to form modules of the material and to locate the modules in side-by-side relation, each module being held under compression. Each module can be carried on a rod and the modules are individually secured to the rod and/or the wall by ties. For example, U.S. Pat. No. 4524702 describes a system in which wire clips are tied at one end to the module rod and at the other end are looped around a reinforcing bar connected to the back plate of the wall. European patent publication No. 0165205 describes a system in which clips connected to the module rods have C shaped heads to slide along a T shaped reinforcing bar or spikes are forced through blocks of modules and are held at the ends in tabs of a support plate also connected to the back plate. The assembly can be awkward to make and requires at least two men to work together. From time to time repairs need to be made and this is awkward to do because the ties must be cut e.g. using pliers or like tools.

It is one object of the invention to provide a substantially tool free method of assembling a lining of a heat chamber which does not require the presence of two workmen to make the assembly, and which assembled lining can readily be repaired as and when the need arises. It is another object of the invention to provide a wall having a lining formed of modules subject to a predetermined degree of compression, and which is engineered so that the need for repair is reduced but which can readily be repaired should the need arise.

According to one aspect of the invention there is provided a wall of a heat chamber having an insulating lining, the lining being formed of at least one row of modules of heat insulating material, each module being supported on a module rod extending through the module, elongate hanger means being present towards or adjacent the ends of the module rods, the elongate hanger means having releasable engaging means spaced apart along the hanger means, each engaging means being arranged to engage a module rod so as to support each module under compression individually.

Preferably the module has at least one, preferably at least two, slots or holes through which access may be gained to the suspending rod, so that the module may be readily engaged with the hanger means. Where the module is made of readily penetrable material, the hanger means may be used to penetrate the material in the absence of preformed slots or holes.

Preferably, the releasable engaging means comprises hook portions each having a socket to receive the module rod. The hook portions are spaced apart by a distance selected so as to hold the respective modules in compression. The distance is selected so as to hold the modules under a minimum compression of about 20% to about 40% of their thickness.

The releasable engaging means is preferably shaped so that only one operator is needed to engage and disengage the module from the respective hanger means.

In a preferred aspect there is provided a wall of a heat chamber, the wall comprising a support surface and a heat insulating lining extending generally parallel to the support surface, the lining being formed of at least one row of modules of ceramic fibre heat insulating material, each module comprising a length of the material folded over module rod means to define two side portions with a bight portion, the modules being arranged in side by side relation with the module rods extending generally parallel to each other with the bight portions located adjacent the support surface, hanger rod means passing through the modules, the hanger rod means having spaced apart hook portions each defining a socket to receive a respective module rod, the module rods being received and locked in in the respective sockets, the sockets being spaced apart by a distance to compress the modules by at least about 20% to 40% of their thickness.

In another aspect, the invention provides a method of assembling a lining of a row of modules of heat insulating material on a wall, each module being held on a module rod extending therethrough, elongate hanger means being connected to the wall, the hanger means having releasable engaging means spaced apart along the hanger means, the method comprising moving each module on to the hanger means so as to engage the module rod with the respective releasable engaging means.

The releasable engaging means is preferably secured to a permanent wall (such as an outer wall, roof, lid, cover, door, etc.) of the chamber. This wall may be solid as in a plate or formed of wire mesh or perforated plate. The engaging means may be bolted, welded or otherwise secured to the wall.

The heat chamber may be used for any treatment of metal, ceramic, clay or like objects at high temperature where insulation is required to prevent undue heat loss. The lining may be present on a side wall, floor or roof, cover or lid of the chamber. The chamber may be for example a furnace, oven, ladle, tundish, forge, kiln, soaking pit or the like.

Figure 2:
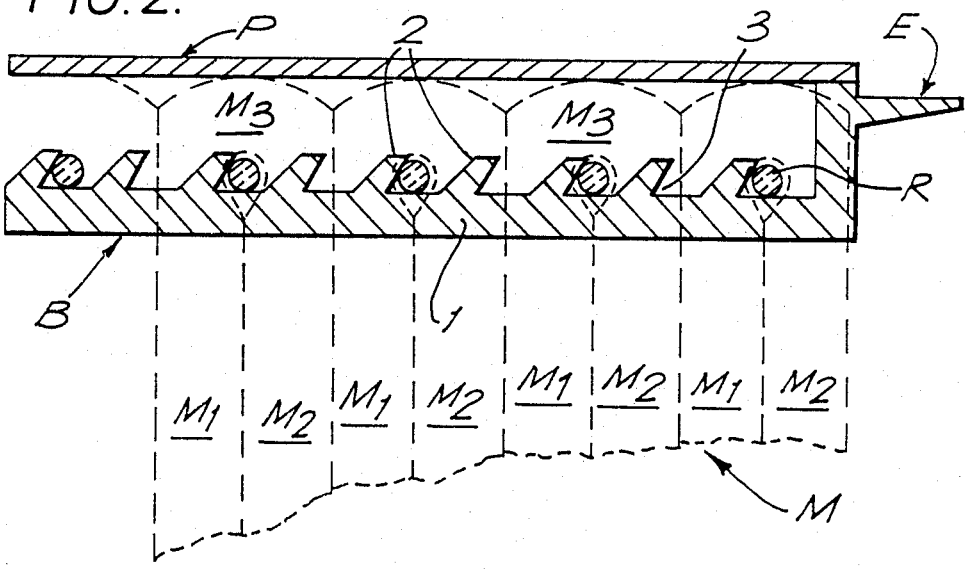
Figure 3:
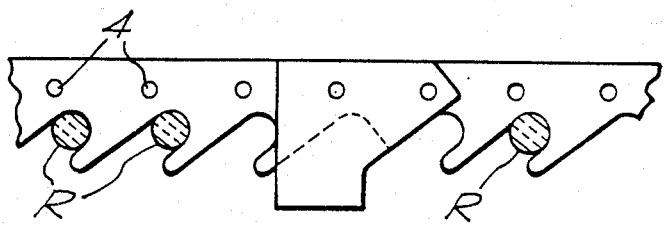

In order that the invention may be well understood it will now be described by way of illustration only, with reference to the accompanying diagrammatic drawings, in which FIG. 1 is a side elevation of one module supported according to the invention;

FIG. 2 is a transverse sectional view taken on lines II—II of FIG. 1; and FIG. 3 is a part sectional view as FIG. 2, but drawn to an enlarged scale.

The module M of the drawings is arranged in a row with others to form a row of a lining (not shown) on the inside face of a heat chamber wall. The module is cut as a rectangular piece of a ceramic fibre blanket batt, mat or like high temperature material. For example, the module may be about 2.5 cm thick in relaxed condition and about 61 cm wide. Where required several such pieces may be stitched together to form a module of the required wall thickness. The module M is folded over a module rod R e.g. a metal or ceramic rod, so that the two side portions M1, M2 hang down. In use the module is compressed so that the side portions M1, M2 are urged together.

According to the invention, slots S or holes are cut in the bight M3 of the module and at the level of the module rod R. At least one pair of elongate hanger bars B extends across the module M and the bars are received in the slots S or holes in releasable engagement with the module rod R. As best shown in FIG. 2, each bar B has an elongated body 1 having at longitudinally spaced apart locations hook portions 2 each forming a socket adapted to receive and engage a module rod R. The hook portion 2 has an angled recess 3 allowing the module rod R to be led in to the socket in cam fashion and prevented from upward movement. The distance between the hook portions 2 is selected so that adjacent modules can be fitted and compressed as required. It is preferred that the compression be at least about 20% to about 40%, preferably about 33%, of its thickness. The bar is secured either permanently or releasably to an upper support e.g. a plate P and may have a spacer element E to space the bar from an adjacent end wall. As shown in FIG. 1, the bar B is welded or otherwise secured via a bracket to the underside of an upper support P. When the modules M are assembled in a row , the space for the last module to be inserted may be less than required, (because of the neighbouring modules) in which case they are urged apart using a piece of board or the like to allow the module in, and then relaxed. This may be done by one operator without using tools. When a damaged module needs to be replaced, neighbouring modules are urged apart, and the damaged module M is released by urging the module rod R away from the hook portion 2 and then lifting it out. A new module M is then fitted as described.

As shown in FIG. 3, the hanger bar B may have spaced apart holes 4. In some cases, the plate may be too long to support a single bar B easily. In such a case lengths of bars B may be used, and the ends of such lengths may be overlapped and held together by wire ties or cotter pins (not shown) passed through the aligned holes 4.

It will be noted that, because each module is located and locked in an individual engaging means, the lining is reliably anchored and the modules each have a predetermined degree of compression. Such a lining is engineered so as not to fail in use, but, as indicated above, should the need arise it is easy to replace one module or a block of such modules.

The invention is not limited to the embodiment shown. Although as shown the bar B is secured to an upper plate P, but it may instead be secured at its ends to opposite sides of the chamber. The bar B may also penetrate the module in the absence of preformed slots or holes. The hanger means may be provided with many hook portions, not all of which need be used in any individual assembly. The modules of ceramic fibre may be arranged to be folded about each other, e.g. "S" folded, to be interlocked or concertinaed.

I claim:

1. A wall of a heat chamber having an insulating lining, the lining being formed of at least one row of modules of heat insulating material, each module being supported on a module rod extending through the module, elongate hanger means being present towards or adjacent the ends of the module rods, the elongate hanger means having releasable engaging means spaced apart along the hanger means, each engaging means being arranged to engage a module rod so as to support each module under compression individually; and wherein the releasable engaging means comprises a row of saw teeth like sockets extending along one edge of the hanger means.

2. A heat chamber wall having an insulating lining;

said lining comprising at least one row of modules of heat insulating material, each module comprising a length of material folded over to define two side portions with a bight portion, and means for supporting said modules;

said supporting means comprising:

a module rod supporting each of said modules, extending through its assoiated module;

elongated hanger means for supporting said module rods and having releasable engaging means spaced apart therealong; and said releasable engaging means positioned with respect to said modules and module rods so as to comprise means for individually compressing each module, independent of the other modules.

3. A wall as recited in claim 2 wherein said means for individually compressing each module comprises means for holding the module under a compression of at least about 20% to 40% of its thickness.

4. A wall according to claim 2, wherein the releasable engaging means comprise hook portions each having a socket to receive the module rod.

5. A wall according to claim 4, wherein the hook portions are spaced apart by a distance selected so as to hold the respective modules in compression.

6. A wall according to claim 2, wherein said elongated hanger means is operatively secured to said wall.

7. A wall according to claim 6, wherein the hanger means is permanently operatively secured to the wall.

8. A wall according to claim 7 wherein the elongated hanger means is secured at each end to the sides of the wall.

9. A wall according to claim 2, wherein the wall has a support plate formed of a solid metal plate.

10. A wall according to claim 2, wherein the wall is part of a soaking pit.

11. A wall according to claim 2, wherein the releasable engaging means comprises a row of saw teeth like sockets extending along one edge of the hanger means.

12. A wall of a heat chamber, the wall comprising a support surface and a heat insulating lining extending generally parallel to the support surface, the lining being formed of at least one row of modules of ceramic fibre heat insulating material, each module comprising a length of the material folded over module rod means to define two side portions with a bight portion, the modules being arranged in side by side relation with the module rods extending generally parallel to each other with the bight portions located adjacent the support surface, hanger rod means passing through the modules, the hanger rod means having spaced apart hook portions each defining a socket to receive a respective module rod, the module rods being received and locked in the respective sockets, the sockets being spaced apart a distance sufficient so that the modules are compressed by at least about 20% to 40% of their thickness.

13. A wall according to claim 12, wherein the compresison is about 33%.

14. A wall as recited in claim 12 wherein said sockets comprise a row of saw teeth like sockets extending along one edge of said hanger rod means.

15. A method of providing a heat insulating wall comprising the steps of:

assembling a plurality of modules of heat insulating material, each module comprising a length of material folded over to define two side portions with a bight portion;

placing the modules adjacent each other to provide a wall which comprises at least one row of modules; and individually compressing each module, independent of the other modules.

16. A method as recited in claim 15 comprising the further step of replacing one module without removing the other modules in the row in which the module to be replaced is provided.

17. A method as recited in claim 16 wherein each of the modules is supported on a rod by hanger means having readily releasable engagement with the rod; and wherein said replacing step is practiced by removing the rod of the module to be replaced from the hanger means, without the necessity of any tools, and inserting a new module supported on a rod in its place.

18. A method as recited in claim 15 wherein said compressing step is practiced so as to compress each of the modules about 20–40% of its thickness.

19. A method as recited in claim 18 wherein said compressing step is practiced so as to compress each of the modules about 33% of its thickness.

* * * * *